US006179279B1

(12) United States Patent
Asai et al.

(10) Patent No.: US 6,179,279 B1
(45) Date of Patent: Jan. 30, 2001

(54) GRIPPING DEVICE

(75) Inventors: Akira Asai, Osaka; Takashi Asai, Wakayama; Yoshiro Asai, Nara, all of (JP)

(73) Assignee: Kabushiki Kaisha Asai Tekkosho, Osaka (JP)

( * ) Notice: Under 35 U.S.C. 154(b), the term of this patent shall be extended for 0 days.

(21) Appl. No.: 09/271,901

(22) Filed: Mar. 18, 1999

(30) Foreign Application Priority Data

Apr. 7, 1998 (JP) ..... 10-094146

(51) Int. Cl.[7] ..... B25B 1/02

(52) U.S. Cl. ..... 269/164; 269/246; 269/251; 269/272; 269/902; 269/268

(58) Field of Search ..... 269/902, 272, 269/164, 246, 251, 268

(56) References Cited

U.S. PATENT DOCUMENTS 468,272 * 2/1892 Watt ..... 269/272
2,573,275 * 10/1951 Roberts ..... 269/164

* cited by examiner

*Primary Examiner*—Robert C. Watson
(74) *Attorney, Agent, or Firm*—Wenderoth, Lind & Ponack, L.L.P.

(57) ABSTRACT

A gripper which is structurally simple and can reliably and quickly grip small articles of various different shapes. The gripper has a base including a fixed portion and a movable portion movable longitudinally toward and away from the fixed portion, a first gripper portion provided on the fixed portion, a second gripper portion provided on the movable portion, and a moving/fixing mechanism for gripping a small article of an indefinite shape by moving the second gripper portion toward the first gripper portion.

14 Claims, 6 Drawing Sheets

GRIPPING DEVICE

BACKGROUND OF THE INVENTION

The present invention relates to a device for gripping articles having various shapes.

In order to grip articles having triangular, semicircular, trapezoidal, L and other shapes, particularly small ones, it was necessary to machine gripping surfaces according to the contour of an article to be gripped, or use V-blocks and liners in combination.

But conventional methods are low in versatility and workability. Also, it was extremely difficult to fix a small article to be gripped in a parallel or vertical position with respect to an X-Y table of a machine tool.

An object of the present invention is to provide a gripper which is structurally simple and can reliably and quickly grip small articles of different shapes.

SUMMARY OF THE INVENTION

According to the present invention, there is provided a gripper for gripping an article having an irregular shape, comprising a base, a fixed member mounted on the base, a movable member mounted on the base so as to be movable in a first direction toward and away from the fixed member, a first gripper portion provided on the fixed member and having a first gripper groove having a V shape in plan view, a second gripper portion provided on the movable member and having a second gripper groove having a V shape in plan view and arranged opposite the first gripper groove, and a moving/fixing means for moving the second gripper portion toward the first gripper portion together with the movable member so that an article K will be gripped firmly between the first and second gripping portions. The second gripper portion is slidable in a second direction perpendicular to the first direction relative to the first gripper portion. Each of the first and second gripper portions comprises a plurality of plates arranged in vertical tiers like a comb and adapted to be inserted in spaces defined by the plates of the other gripper portion.

According to the present invention, there is also provided a gripper for gripping an article having an irregular shape, comprising a base, a fixed member mounted on the base, a movable member mounted on the base so as to be movable in a first direction toward and away from the fixed member, a first gripper portion provided on the fixed member and having a first gripper groove having a V shape in plan view, a second gripper portion provided on the movable member and having a second gripper groove having a V shape in plan view and arranged opposite the first gripper groove, and a moving/fixing means for moving the second gripper portion toward the first gripper portion together with the movable member so that an article K will be gripped firmly between the first and second gripping portions. The first gripper portion is slidable in a second direction perpendicular to the first direction relative to the second gripper portion. Each of the first and second gripper portions comprises a plurality of plates arranged in vertical tiers like a comb and adapted to be inserted in spaces defined by the plates of the other gripper portion.

Other features and objects of the present invention will become apparent from the following description made with reference to the accompanying drawings, in which:

DETAILED DESCRIPTION OF THE PREFERRED EMBODIMENT

The present invention is now described in detail with reference to the drawings showing embodiments of the invention.

Figure 1:
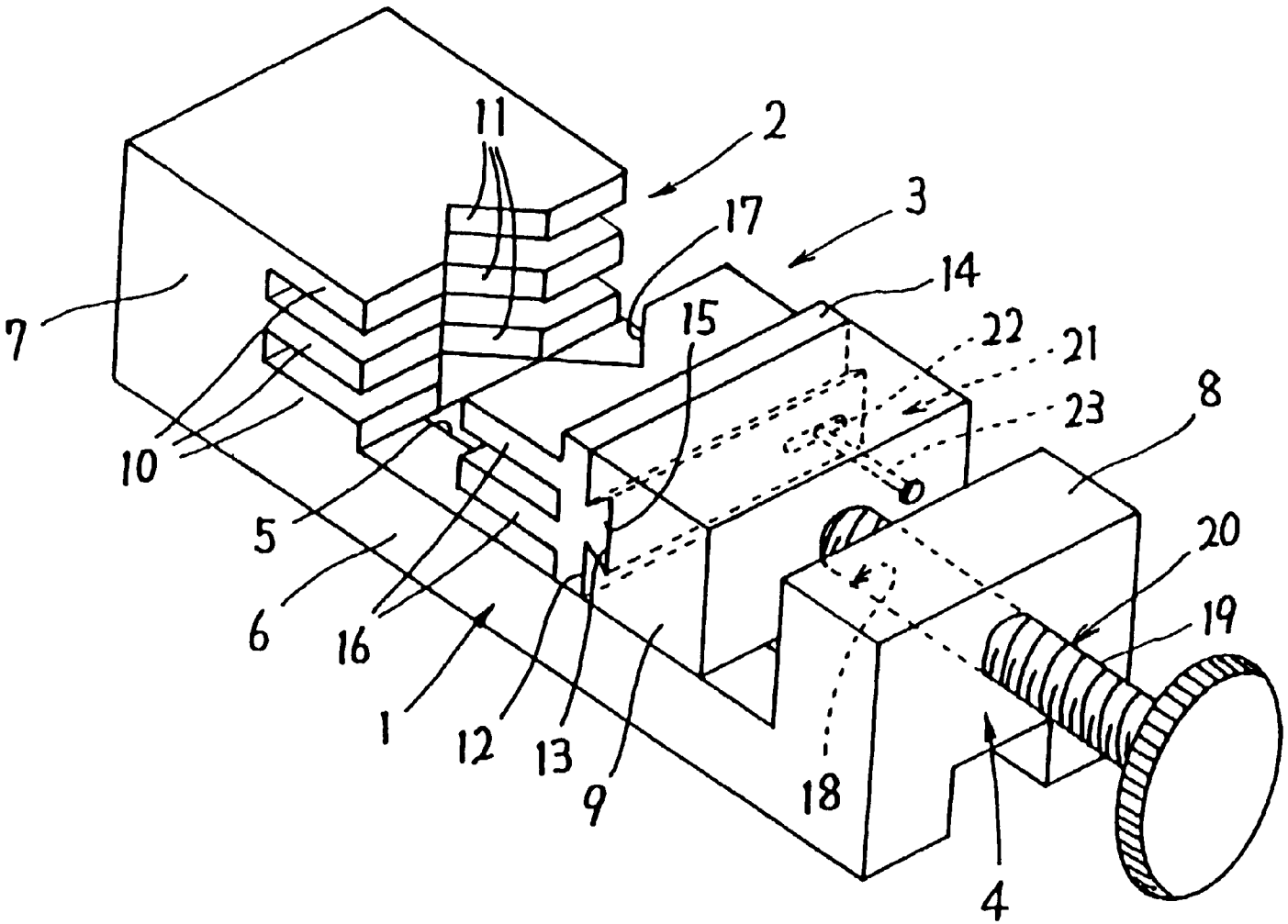
FIG. 1 is a perspective view of a gripper embodying the present invention.

FIG. 1 shows a gripper for gripping small articles with various irregular shapes, embodying the present invention. This gripper comprises a base 1, a first and a second gripper unit 2 and 3 provided on the base 1, and a moving/fixing unit 4 for moving the second gripper unit 3 toward and away from the first gripper unit 2 and fixing it in a desired position.

Figure 2:
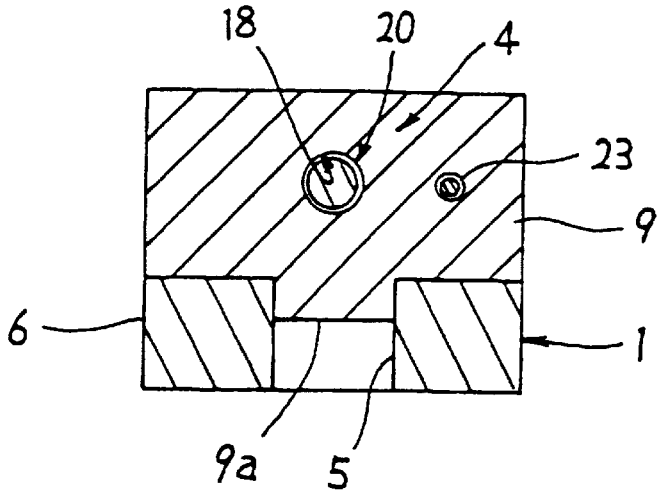
FIG. 2 is a partial sectional view of a base of the gripper.
Figure 3:
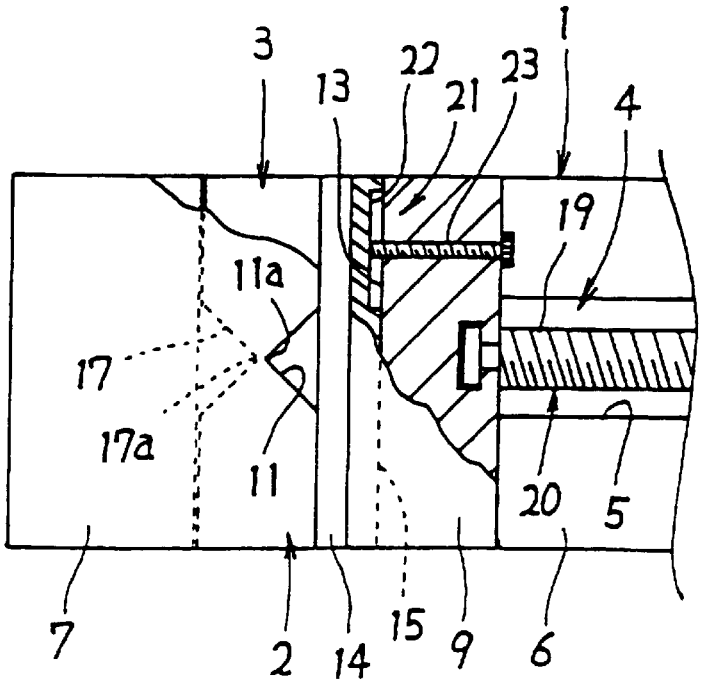
FIG. 3 is a partially sectional, partial plan view of first and second gripper portions when they are moved close to each other.

To be more specific, as shown in FIGS. 1–3, the base 1 comprises a guide portion 6 having a longitudinal guide slit 5, fixed blocks 7 and 8 provided at the front and rear ends of the guide portion 6, and a movable block 9 mounted so as to be movable along the guide portion 6 between the blocks 7 and 8.

The movable block 9 has on its bottom a rib 9*a* slidably received in the guide slit 5 of the guide portion 6 so as to be slidable between the fixed blocks 7 and 8. In the illustrated embodiment (FIG. 2), the guide slit 5 has a uniform width but may be dimensioned such that its width gradually increases downwardly like a dovetail. In this case, the rib 9*a* of the movable portion 9 is also formed like a dovetail complementary to the dovetail-shaped slit 5.

The first gripper portion 2 comprises plate members 10 protruding rearwardly from the fixed block 7 at the front end of the base 1 in a plurality of (three in the embodiment) vertical tiers. Each plate member 10 has along a rear edge thereof a V-shaped (in plan) first gripping groove 11 vertically aligned with the grooves 11 of the other plates 10.

The second gripper portion 3 comprises a vertical wall 14 having a rib 15 engaged in a dovetail groove 13 formed in the front surface 12 of the movable block 9, and plate members 16 protruding from the vertical wall 14 toward the first gripper portion 2 in a plurality of (two in the embodiment) vertical tiers. Each plate 16 has along its front edge a V-shaped (in plan view) second gripper groove 17 opposite the first gripper grooves 11 of the first gripper portion 2.

The plates 16 of the second gripper portion 3 are inserted into the spaces defined between the plates 10 of the first gripper portion 2. When the plates 16 are inserted most deeply into the spaces between the plates 10, the corners 17*a* of the second gripper grooves 17 substantially align with the corners 11*a* of the first gripper grooves 11 (FIG. 3).

The moving/fixing unit 4 comprises a threaded hole 18 formed in the fixed block 8 at the rear end of the base 1, and a bolt 20 having threads 19 threaded into the threaded hole 18 and into the movable block 9. By turning the bolt 20, the movable block advances and retracts relative to the fixed block 8 to move the second gripper portion 3 together with the movable block 9.

The gripper according to the present invention further includes a stopper 21 for restricting transverse sliding movement of the second gripper portion 3. The stopper 21 comprises a transverse groove 22 formed in the rib 15 of the second gripper portion 3, and a stopper pin 23 extending through the movable block 9 and having its tip received in the groove 22. For example, the stopper pin 23 may be a threaded pin threaded into a threaded hole formed in the movable block 9. The stopper 21 prevents the second gripper portion 3 from unduly coming off the movable block 9.

Figure 4:
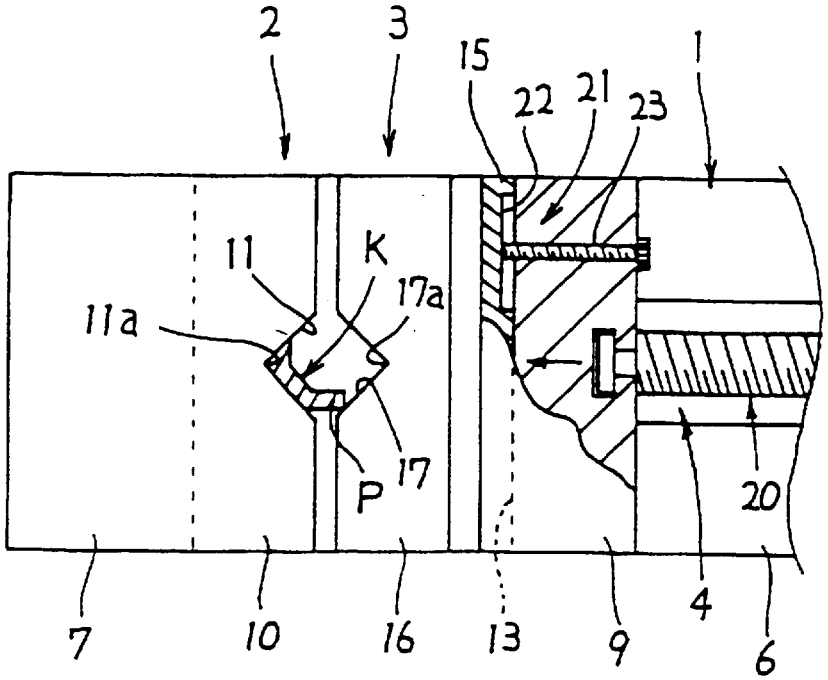
FIG. 4 is a partially sectional, partial plan view showing a state in which a small article is about to be gripped.
Figure 5:
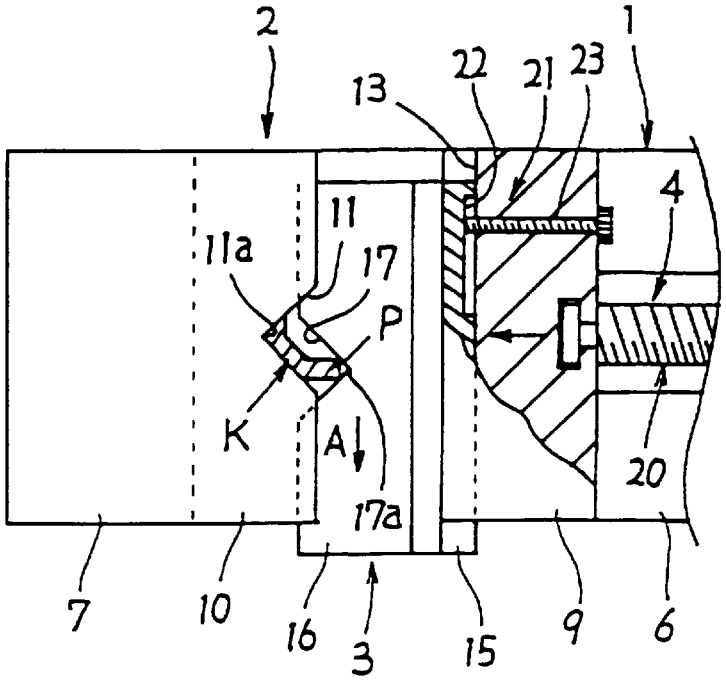
FIG. 5 is a partially sectional, partial plan view showing a small article gripped.

As shown in FIGS. 4 and 5, in order to grip a small article K for machining, with the article K pressed against the corners 11*a* of the first gripper grooves 11 of the first gripper portion 2, the bolt 20 of the moving/fixing unit 4 is turned to advance the second gripper portion 3 toward the first gripper portion 2 together with the movable block 9 until the inclined surfaces of the second gripper grooves 17 abut part P (protruding toward the second gripper portion 3) of the article K. When the second gripper portion 3 is further advanced from this position, it will slide in the direction of the arrow A until the corners 17*a* of the second gripper grooves 17 are pressed against part P of the article K. By tightening the bolt 20 in this state, the article K is firmly gripped by the first and second gripper portions 2 and 3.

Figure 6:
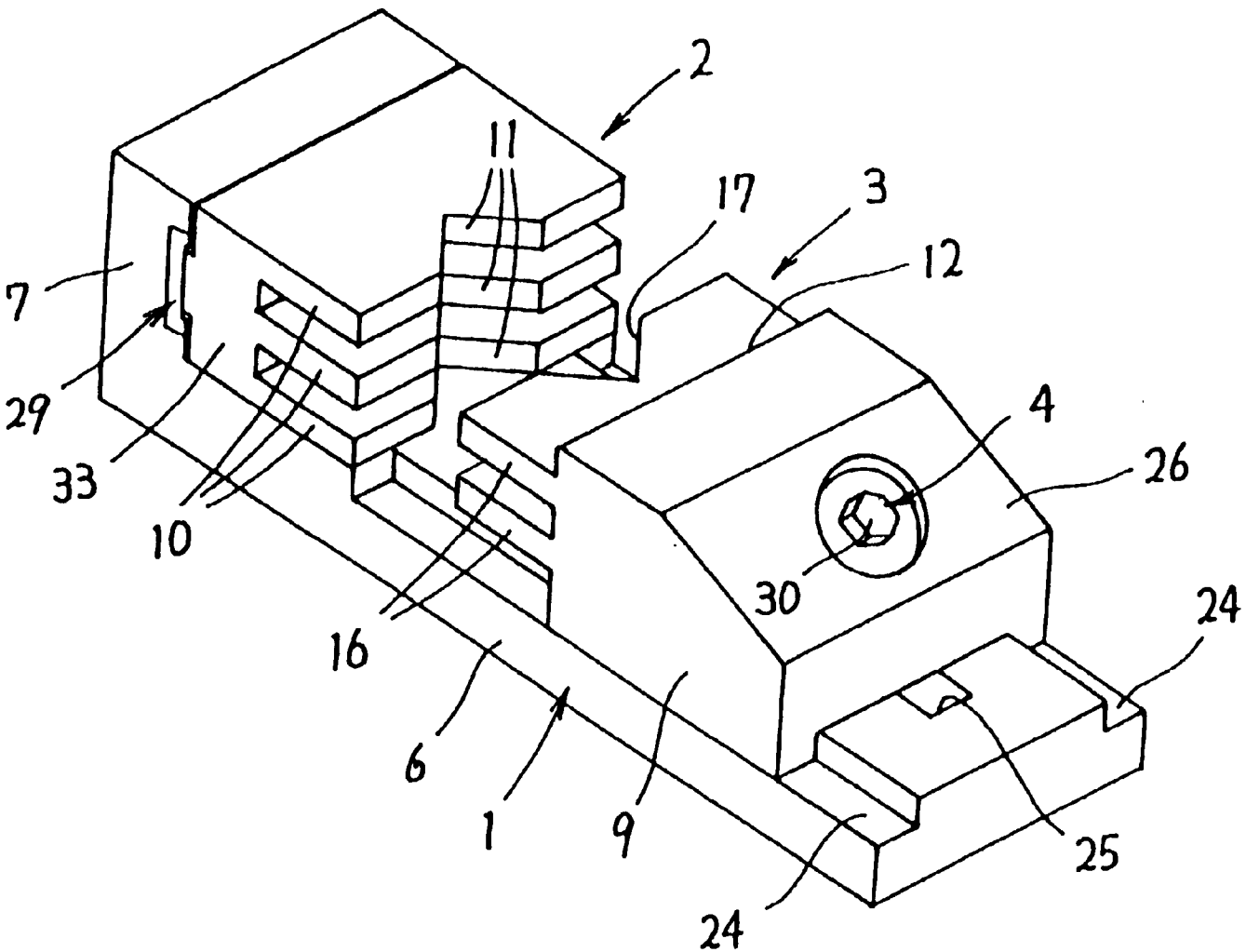
FIG. 6 is a perspective view of another embodiment.
Figure 7:
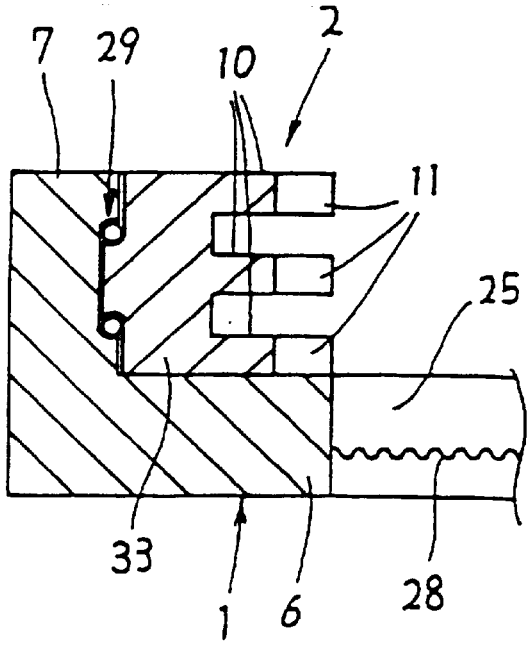
FIG. 7 is a side view in section of a first gripper portion of the FIG. 6 embodiment.
Figure 8:
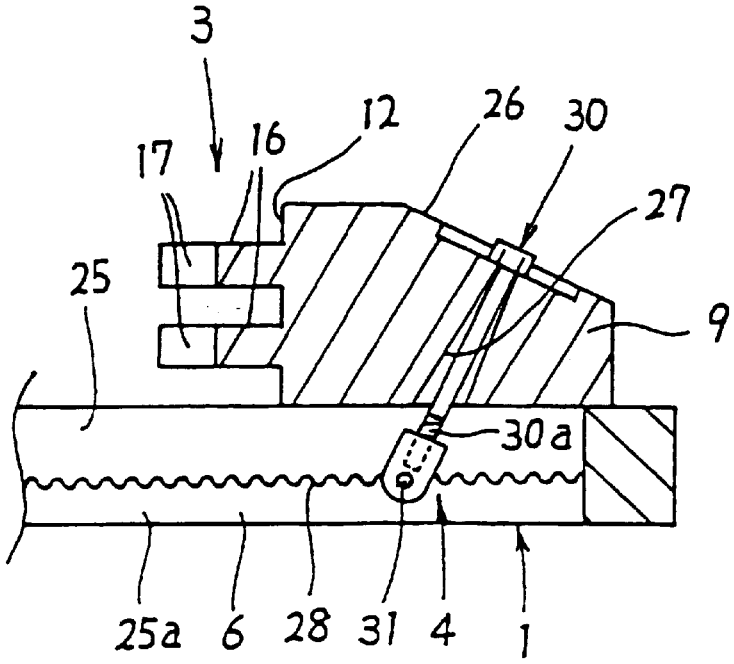
FIG. 8 is a side view in section of a second gripper portion of the FIG. 6 embodiment.

FIG. 6 shows another gripper embodying the present invention. This gripper comprises a base 1 having a fixed block 7 at the front end and a movable block 9 movable longitudinally toward and away from the fixed block 7, a first gripper portion 2 provided on the fixed block 7, a second gripper portion 3 provided on the movable block 9, and a moving/fixing unit 4 for moving the second gripper portion 3 toward and away from the first gripper portion 2 together with the movable block 9.

Specifically, as shown in FIGS. 6–9, the base 1 has a guide portion having longitudinal cutout guide grooves 24 formed along side edges thereof, and a longitudinal slit 25 provided between the guide grooves 24. The fixed block 7 is provided at the front end of the guide portion 6. The movable block 9 is slidable along the guide grooves 24 of the guide portion 6.

Figure 9:
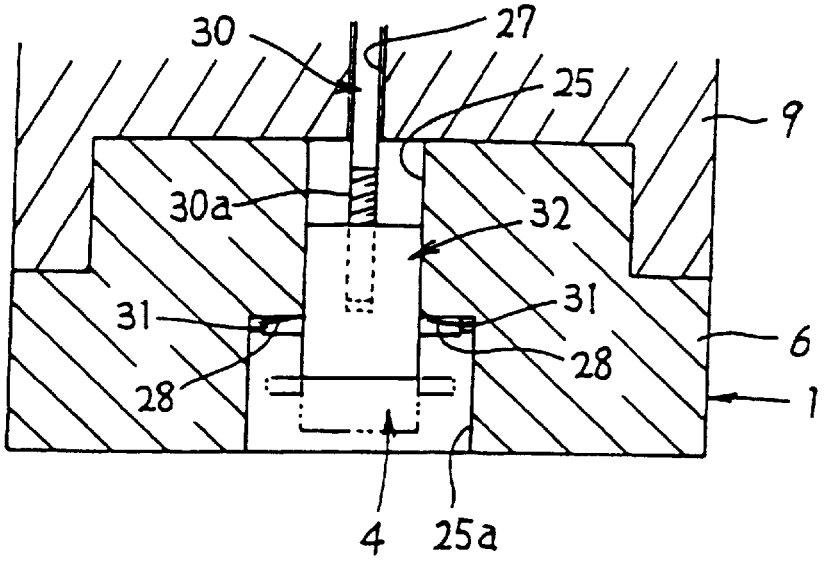
FIG. 9 is a sectional view showing how a moving/fixing means engage.

Under the slit 25, the guide portion 6 has a wide hole 25*a* having a corrugated ceiling 28 (FIG. 9). The movable block 9 has a chamfered surface 26 at its rear end, and is formed with a hole 27 extending forwardly and downwardly from the chamfered surface 26. The diameter of the hole 27 increases downwardly.

The first gripper portion 2 comprises a block 33 having three plates 10 protruding rearwardly from the block 33 in vertical tiers like a comb as seen from one side (FIG. 7), and is transversely slidable along the fixed block 7 of the base 1. A linear guide bearing 29 is provided between the block 33 of the first gripper portion 2 and the fixed block 7 (FIG. 6).

The second gripper portion 3 comprises two plates 16 integrally formed on the front face 12 of the movable block 9 in vertical tiers. The plates 10 and 16 of the first and second gripper portions 2 and 3 mesh together when the gripper portions 2, 3 move toward each other.

The moving/fixing unit 4 comprises a bolt 30 inserted in the hole 27 of the movable block 9, a polygonal nut 32 (FIG. 9) threaded onto male threads 30*a* at the tip of the bolt 30 and having protrusions 31 on both sides thereof, and the corrugated ceiling 28 formed on the guide portion 6 and adapted to engage the protrusions 31 at a predetermined longitudinal position. The nut member 32 has substantially the same width as the width of the slit 25 of the guide portion 6 at its upper portion.

By turning the exposed head of the bolt 30, the polygonal nut 32 moves up and down relative to the threads 30*a*, so that the protrusions 31 engage and disengage from the corrugated ceiling 28.

Figure 10:
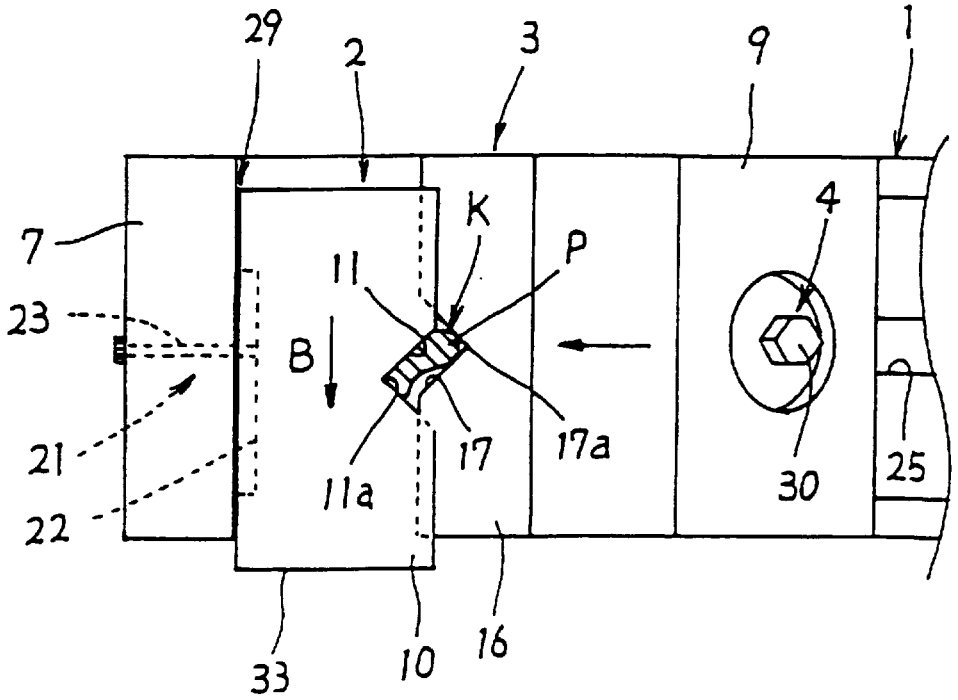
FIG. 10 is a partially sectional, partial plan view showing how an article is gripped.

As shown in FIG. 10, the gripper further includes a stopper 21 for restricting transverse movement of the first gripper portion 2. The stopper 21 comprises a narrow transverse groove 22 formed in the front face of the block 33 of the first gripper portion 2, and a stopper pin 23 extending through the fixed block 7 and having its tip received in the groove 22. The stopper 21 prevents the first gripper portion 2 from unduly coming off the fixed block 7.

In order to grip a small article K for machining, with the article K pressed against the corners 11*a* of the first gripper grooves 11 of the first gripper portion 2, the second gripper portion 3 is slid toward the first gripper portion 2 together with the movable block 9, and then, as shown in FIG. 10, the first gripper portion 2 is slid in the direction of arrow B until the corners 17*a* of the second gripper grooves 17 are pressed against part P (protruding toward the second gripper portion 3) of the article K.

With the article K gripped by the first and second gripper grooves 11, 17, the bolt 30 of the moving/fixing unit 4 is tightened. When it is tightened, the nut 32 is raised as shown in FIG. 9, so that the protrusions 31 engage the corrugations 28. When the bolt 30 is tightened further firmly, it pivots counterclockwise (in FIG. 8) about the protrusion 31 in a space around the bolt in the hole 27 formed in the movable block 9, so that the movable block 9 and the second gripper portion 3 advance a little. The article K is thus gripped further firmly between the first and second gripper grooves 11, 17.

The present invention is not limited to the above embodiments. For example, the gripper of FIGS. 1 and 2 may be modified such that the first gripper portion 2 is slidable transversely, and the second gripper portion 3 is integral with the movable block 9. Also, the gripper of FIGS. 6 and 7 may be modified such that the first gripper portion 2 is integral with the fixed block 7 and the second gripper portion 3 is transversely slidable.

According to the invention, a small article K having an irregular shape can be gripped easily and reliably without the need to work the chucking surfaces or use V-blocks and liners. It is possible to grip the article K with its reference surface arranged perpendicularly to or in the moving direction of an X-Y table of a machine tool. Thus, the gripper of the invention can handle articles having various shapes and thus is versatile. Also, the gripper of the invention is relatively simple in structure and easy to manufacture.

According to the invention, the stopper prevents the first or second gripper portion from unduly coming off.

What is claimed is:

1. A gripper for gripping an article having an irregular shape, comprising a base, a fixed member mounted on said base, a movable member mounted on said base so as to be movable in a first direction toward and away from said fixed member, a first gripper portion provided on said fixed member and having a first gripper groove having a V shape in plan view, a second gripper portion provided on said movable member and having a second gripper groove having a V shape in plan view and arranged opposite said first gripper groove, and a moving/fixing mechanism to provide for moving of said second gripper portion toward said first gripper portion together with said movable member so that an article will be gripped firmly between said first and second gripper portions, one of said first and second gripper portions being slidable in a second direction perpendicular to said first direction relative to the other of said first and second gripper portions, each of said first and second gripper portions being non-pivotably supported by said base, and each of said first and second gripper portions comprising a plurality of plates arranged in vertical tiers like a comb and adapted to be inserted in spaces defined by the plates of the other gripper portion.

2. The gripper as claimed in claim 1 further comprising a stopper for restricting sliding movement of said one of said first and second gripper portions in said second direction.

3. The gripper as claimed in claim 1, wherein said other of said first and second gripper portions is non-adjustably fixed against movement in the second direction relative to said base.

4. The gripper as claimed in claim 1, wherein said moving/fixing mechanism comprises a securing member engaged with said base for movement in said first direction relative to said base, said securing member being operably engaged with said movable portion for causing movement of said movable portion in said first direction relative to said base when said securing member is moved in said first direction relative to said base.

5. The gripper as claimed in claim 4, wherein said securing member comprises a bolt threadedly engaged with said base.

6. The gripper as claimed in claim 1, wherein said one of said first and second gripper portions is slidably mounted to one of said fixed and movable members for movement relative thereto in said second direction, said one of said first and second gripper portions is provided with a first stopper part, and said one of said fixed and movable members is provided with a second stopper part engageable with said first stopper part to restrict sliding movement of said one of said first and second gripper portions in said second direction relative to said one of said fixed and movable members.

7. The gripper as claimed in claim 1, wherein said moving/fixing mechanism comprises a securing member engaged with said movable member and adjustably engageable with said base at plural locations.

8. A gripper for gripping an article having an irregular shape, comprising a base, a fixed member mounted on said base, a movable member mounted on said base so as to be movable in a first direction toward and away from said fixed member, a first gripper portion provided on said fixed member and having a first gripper groove having a V shape in plan view, a second gripper portion provided on said movable member and having a second gripper groove having a V shape in plan view and arranged opposite said first gripper groove, and a moving/fixing mechanism to provide for moving of said second gripper portion toward said first gripper portion together with said movable member so that an article will be gripped firmly between said first and second gripper portions, one of said first and second gripper portions being slidable in a second direction perpendicular to said first direction relative to said base, the other of said first and second gripper portions being non-adjustably fixed against movement in the second direction relative to said base, and each of said first and second gripper portions comprising a plurality of plates arranged in vertical tiers like a comb and adapted to be inserted in spaces defined by the plates of the other gripper portion.

9. The gripper as claimed in claim 8, further comprising a stopper for restricting sliding movement of said one of said first and second gripper portions in said second direction.

10. The gripper as claimed in claim 8, wherein said moving/fixing mechanism comprises a securing member engaged with said base for movement in said first direction relative to said base, said securing member being operably engaged with said movable portion for causing movement of said movable portion in said first direction relative to said base when said securing member is moved in said first direction relative to said base.

11. The gripper as claimed in claim 10, wherein said securing member comprises a bolt threadedly engaged with said base.

12. The gripper as claimed in claim 8, wherein said one of said first and second gripper portions is slidably mounted to one of said fixed and movable members for movement relative thereto in said second direction, said one of said first and second gripper portions is provided with a first stopper part, and said one of said fixed and movable members is provided with a second stopper part engageable with said first stopper part to restrict sliding movement of said one of said first and second gripper portions in said second direction relative to said one of said fixed and movable members.

13. The gripper as claimed in claim 8, wherein said moving/fixing mechanism comprises a securing member engaged with said movable member and adjustably engageable with said base at plural locations.

14. The gripper as claimed in claim 13, wherein said fixing member comprises a bolt extending through said movable member, and an adjustment member secured to said bolt and engageable in engagement parts provided at said plural locations of said base.

* * * * *